US009297386B2

(12) United States Patent
Bottan

(10) Patent No.: US 9,297,386 B2
(45) Date of Patent: Mar. 29, 2016

(54) COOLING SYSTEMS FOR SUBMERSIBLE PUMPS

(75) Inventor: Davide Bottan, Modena (IT)

(73) Assignee: ZENIT INTERNATIONAL S.A., Luxembourg (LU)

( * ) Notice: Subject to any disclaimer, the term of this patent is extended or adjusted under 35 U.S.C. 154(b) by 326 days.

(21) Appl. No.: 13/822,549

(22) PCT Filed: Sep. 13, 2011

(86) PCT No.: PCT/EP2011/065859

§ 371 (c)(1), (2), (4) Date: Mar. 12, 2013

(87) PCT Pub. No.: WO2012/035016

PCT Pub. Date: Mar. 22, 2012

(65) Prior Publication Data

US 2013/0183178 A1 Jul. 18, 2013

(30) Foreign Application Priority Data

Sep. 13, 2010 (LU) ..... 91731

(51) Int. Cl.

| | |
|---|---|
| ***F04D 13/08*** | (2006.01) |
| ***F04D 29/06*** | (2006.01) |
| ***F04D 29/12*** | (2006.01) |
| ***F04D 29/58*** | (2006.01) |
| ***F04D 25/06*** | (2006.01) |

(52) U.S. Cl.

CPC ..... *F04D 13/086* (2013.01); *F04D 13/08* (2013.01); *F04D 25/0686* (2013.01); *F04D 29/06* (2013.01); *F04D 29/061* (2013.01); *F04D 29/12* (2013.01); *F04D 29/126* (2013.01); *F04D 29/58* (2013.01); *F04D 29/588* (2013.01)

(58) Field of Classification Search

CPC ..... H02K 5/132; F04D 25/0686; F04D 13/08; F04D 13/086; F04D 29/108; F04D 29/128; F04D 29/586; F04D 29/5806

USPC ..... 417/423.3, 423.8, 423.11, 366, 367, 417/368

See application file for complete search history.

(56) References Cited

U.S. PATENT DOCUMENTS 2,002,907 A * 5/1935 Sessions ..... F04D 13/083 277/427
2,506,827 A * 5/1950 Goodner ..... F04D 13/083 277/361

(Continued)

FOREIGN PATENT DOCUMENTS

DE 528898 C 7/1931
EP 1908960 A1 4/2008

OTHER PUBLICATIONS

EPO Office Action issued on Sep. 10, 2015.

*Primary Examiner* — Alexander Comley
(74) *Attorney, Agent, or Firm* — Nath, Goldberg & Meyer; Jerald L. Meyer; Rury L. Grisham

(57) ABSTRACT

A pump (1) includes a shaft (21) for driving an impeller (81) in a pump chamber (80); an electrical motor chamber (60) extending essentially circumferentially around a motor section of the shaft (21); a cooling circuit chamber (30) for being filled with a cooling liquid; and a mechanical seal chamber (40) extending essentially circumferentially around a seal section of the shaft (21), with the mechanical seal chamber (40) adapted for being filled with oil. The pump (1) may be a submersible pump.

20 Claims, 4 Drawing Sheets

(56) References Cited

U.S. PATENT DOCUMENTS 3,136,258 A * 6/1964 Bood ..... H02K 5/132 417/367
3,153,382 A * 10/1964 Van Blarcom, Jr. .. F04D 13/086 277/348
3,304,876 A * 2/1967 Stahl ..... F04D 13/08 277/367
3,339,491 A * 9/1967 Malloch ..... F04D 7/02 415/175
3,371,613 A * 3/1968 Dahlgren ..... F04D 29/586 310/54
3,653,785 A * 4/1972 Dahlgren ..... H02K 9/19 165/104.31
3,746,472 A * 7/1973 Rupp ..... F04D 15/0263 277/320
3,748,066 A * 7/1973 Sully ..... F04D 29/126 415/121.2
3,822,967 A * 7/1974 Cade ..... F04D 15/02 417/368
4,181,475 A * 1/1980 Stahl ..... F04D 13/086 417/372
4,349,322 A * 9/1982 Stahle ..... F04D 29/586 415/112
4,475,873 A * 10/1984 Jensen ..... H02K 3/50 310/71
4,523,899 A * 6/1985 Ouchi ..... F04D 29/126 415/174.3
4,614,904 A * 9/1986 Yamazaki ..... H02P 1/44 310/87
4,934,914 A * 6/1990 Kobayashi ..... F04D 9/005 137/533.11
4,966,532 A * 10/1990 Fengsheng ..... F04D 29/108 277/409
5,074,764 A * 12/1991 Kobayashi ..... F04D 29/086 417/423.3
5,250,863 A * 10/1993 Brandt ..... F04D 29/588 310/54
5,281,088 A * 1/1994 Brandt ..... F04D 29/588 415/171.1
5,480,290 A * 1/1996 Zelder ..... F04D 13/086 417/366
5,616,973 A * 4/1997 Khazanov ..... H02K 5/20 310/54
5,823,751 A * 10/1998 Sjoblom ..... F04D 13/086 417/360
6,224,354 B1 * 5/2001 Brandt ..... F04D 29/128 277/428
6,379,127 B1 * 4/2002 Andrews ..... F04D 13/086 277/387
6,422,822 B1 * 7/2002 Holmes ..... F04D 13/083 417/13
6,533,540 B1 * 3/2003 Mathis ..... F04D 29/126 415/109
6,641,140 B1 * 11/2003 Matsumoto ..... F04B 1/0448 277/366
7,264,449 B1 * 9/2007 Harned ..... F04D 15/0218 417/36
7,341,436 B2 * 3/2008 Andrews ..... F04D 7/045 417/369
2007/0201994 A1 * 8/2007 Itani ..... F04D 13/086 417/423.3
2011/0200469 A1 * 8/2011 Kawabata ..... F04D 13/0606 417/423.3

* cited by examiner

COOLING SYSTEMS FOR SUBMERSIBLE PUMPS

This is a National Phase Application filed under 35 U.S.C. 371 as a national stage of PCT/EP2011/065859, filed Sep. 13, 2011, and claims priority from Luxembourg Application No. 91731, filed Sep. 13, 2010, the content of each of which is hereby incorporated by reference in its entirety.

FIELD OF THE INVENTION

The present invention relates to cooling systems for submersible pumps. More particularly, it relates to closed circuit cooling systems for submersible pumps.

TECHNICAL BACKGROUND OF THE INVENTION

Today, in general only two different cooling systems are used for submersible pumps: closed jacket cooling system and open jacket cooling system.

The first system, closed jacket cooling, uses the same pumped liquid to cool the motor thanks to a cooling jacket installed around the cast iron casing, as schematically shown in FIG. 1. In this case the liquid must not contain big solid parts to prevent the cooling circuit flow to be reduced or clogged. The mechanical seals are arranged in an oil chamber. The closed jacket cooling system does not require external water, which can be expensive and sometimes not easily available in the sump, but at the same time, since it uses the dirty liquid for cooling, has major drawbacks. As mentioned before the disadvantage is the use of the same pumped liquid. In pumps intended mainly for sewage, or any other dirty water, the use of the pumped water for cooling can create problems and requires frequent maintenance and cleaning of the cooling circuit.

The second system, shown schematically in FIG. 2, open jacket cooling, uses external water to cool the motor. It can be a closed circuit (with a well dimensioned water reservoir) or the water coming out from the motor, after having cooled it, can be released in the sump. The open jacket cooling system has the advantage that it avoids using the dirty liquid for cooling, but it does require fresh external water for cooling, which can be expensive and sometimes not easily available on site.

These systems are still used by most pump manufacturers today.

In the prior art, a closed loop cooling system with dry motor (i.e. no oil in the motor) and without any additional cooling circulator has been proposed. This system does not need external water or frequent maintenance.

One disadvantage of this prior art system is that, in cooling installed system version, the pumps comes in contact with water not only in the cooling system, but also in the mechanical seals chamber. This last characteristic is the main disadvantage of this prior art system. In submersible pumps it is very common to have the mechanical seals in a separate oil chamber and provide a leakage detector therein. The leakage detector is basically a probe that can detect if the oil is contaminated by water.

The purpose of mechanical seals is to prevent water from reaching the motor. The reason why most manufacturers employ two mechanical seals is because when there is a failure of the first one, the pump does not need to be stopped. The leakage detector gives alarm, and the second seal still prevents the water from going into the motor chamber.

In the above prior art pumps with closed loop cooling system, the oil chamber is filled with glycol, the same as the chamber of the cooling system. In this prior art, a probe can only be placed in the motor to detect when water reaches the motor, i.e. once both mechanical seals have failed. At the same time when this incident happens, it means that the sewage water has entered the first mechanical seals, may be pumped in the cooling system for days and may come in direct contact with the second mechanical seals, since this condition cannot be detected. Only when the second seal fails and the sewage water starts to reach the motor chamber, the water detector installed there can finally switch off the pump.

Hence in this prior art there is no early alarm after which the pump can still run and maintenance be organized. Rather in the system according to that prior art, when there is an alarm, it is too late and the pump has to be switched off immediately.

In that prior art the cooling chamber maintenance will be very difficult due to the sewage liquid stacked around the motor and between the mechanical seals.

Another disadvantage of this prior art is also the normal maintenance. Normally when a pump is serviced, the operator checks the oil level in the mechanical seals. In this configuration the pump cooling liquid, which is the same as for the mechanical seals, has to be emptied completely and refilled.

A further disadvantage is also the poorer characteristic of glycol compared to specifically designed oil for mechanical seals.

A further prior art uses an active circulator to keep the cooling liquid moving. However, the additional electrical external motor required in this case has further disadvantages in that it increases maintenance, requires additional cables to the pump, and generally increases the chances of mechanical failure.

It is therefore an object of the present invention to overcome or alleviate at least some of the disadvantageous of the known cooling systems for submersible pumps.

SUMMARY OF THE INVENTION

In accordance with a first aspect of the present invention, a pump, in particular a submersible pump, comprises a shaft for driving an impeller in a pump chamber. An electrical motor chamber extends essentially circumferentially around a motor section of the shaft. The pump further comprises a cooling circuit chamber for being filled with a cooling liquid. A mechanical seal chamber extends essentially circumferentially around a seal section of the shaft, with the mechanical seal chamber adapted for being filled with oil. The dry electrical motor chamber, the cooling circuit chamber, and the mechanical seal chamber are hermetically sealed from each other.

The electrical motor chamber may be dry or oil filled.

The cooling circuit chamber may extend essentially circumferentially around the shaft.

At least part of the cooling circuit chamber may extend essentially circumferentially around the electrical motor chamber.

At least a part of the cooling circuit chamber extends essentially circumferentially around the mechanical seal chamber.

The pump may further comprising an oil chamber adapted for being filled with oil, wherein the oil chamber extends essentially circumferentially around the mechanical seal chamber.

The oil chamber may extend essentially circumferentially around the part of the cooling circuit chamber extending essentially circumferentially around the mechanical seal chamber.

The oil chamber may be in liquid communication with the mechanical seal chamber.

The pump may further comprise a cooling diffuser essentially enclosing the oil chamber. The cooling diffuser may further provide at least one essentially radial passageway for the oil to pass between the oil chamber and the mechanical seal chamber. The cooling diffuser may further provide at least one essentially axial passageway for the cooling liquid in the cooling circuit chamber. The at least one essentially radial passageway and the at least one essentially axial passageway may be separated from another. Preferably, the at least one essentially radial passageway and the at least one essentially axial passageway may be hermetically separated from another.

The total cross section of the at least one essentially axial passageway may be larger than the total cross section of the at least one essentially radial passageway.

The mechanical seal chamber may comprise a mechanical seal cartridge for separating the dry electrical motor chamber from the pump chamber.

The mechanical seal cartridge may comprise at least one mechanical seal.

The mechanical seal cartridge may comprise at least two mechanical seals.

The mechanical seal chamber may comprise a leak detector.

At least one seal may be provided on the seal section of the shaft for sealing the dry electrical motor chamber from the cooling circuit chamber. This seal may be a lip seal or a mechanical seal.

At least one upper seal may be provided on the seal section of the shaft for sealing the cooling circuit chamber from the mechanical seal chamber. The upper seal may be a V-ring or a lip seal.

At least one lower seal may be provided on the seal section of the shaft for sealing the mechanical seal chamber from the pump chamber. The lower seal may be a V-ring or a lip seal The cooling liquid may comprise glycol. The cooling liquid may further comprise water.

The cooling circuit chamber may be in the form of a closed loop for the cooling liquid.

An internal impeller may be provided for moving the cooling liquid in the closed-loop cooling circuit chamber.

According to a second aspect to the present invention a cooling diffuser is proposed for a pump, in particular a submersible pump. The cooling diffuser provides at least one essentially radial passageway for oil to pass between an oil chamber extending essentially circumferentially at least partially around the cooling diffuser and a mechanical seal chamber extending essentially inside the cooling diffuser. The cooling diffuser further provides at least one essentially axial passageway for a cooling liquid in a cooling circuit chamber, with part of the cooling chamber extending axially through the cooling diffuser. The at least one essentially radial passageway and the at least one essentially axial passageway are hermetically separated from another.

The total cross section of the at least one essentially axial passageway may be larger than the total cross section of the at least one essentially radial passageway.

Advantages

The main advantages of the separation between the cooling circuit and the mechanical seal volume are the following:

The mechanical seal works in oil and may lead to an increased life endurance of the mechanical seal. This may improve the reliability of the submersible pump.

The oil in the mechanical seal chamber may allow the seal system to increase its efficiency, so the total efficiency of the pump may rise.

The separation of the cooling circuit from the mechanical seal area, prevents contamination between those two different volumes. This may be a big improvement of the quality of the pump, because each circuit may always be in the best working conditions.

The optimization of the pump reliability may increase the time interval between the maintenance. This means that the new pump may work much longer than the known pump.

Another advantage of this invention is that the mechanical seals chamber may be inspected without discharging the cooling system circuit.

In addition further advantage of this invention is the possibility to install a leakage detector in the oil chamber.

Owing to the new system geometry in the form of a separation between oil chamber and the cooling circuit, the mechanical seal oil may be changed or inspected without having to drain the glycol from the cooling circuit. This may lead to a reduced maintenance time, and the maintenance costs may be reduced.

BRIEF DESCRIPTION OF THE DRAWINGS

These and other aspects of the invention will now be further described, by way of example only, with reference to the accompanying figures.

DETAILED DESCRIPTION OF THE INVENTION

In accordance with the present invention, a cooling system is proposed that preferably uses a closed loop for the cooling liquid. A preferred cooling liquid may be glycol, or a similar cooling liquid. The present invention provides for two separate chambers for the mechanical seals and the closed cooling circuit.

In this solution the mechanical seals can be always immersed in oil and a leakage detector can be installed like in a conventional pump.

Figure 1:
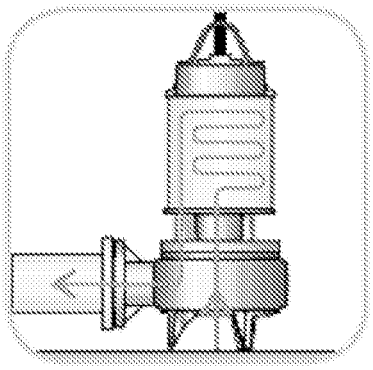
FIG. 1 shows schematic illustrations of a first known cooling system for submersible pumps.
Figure 2:
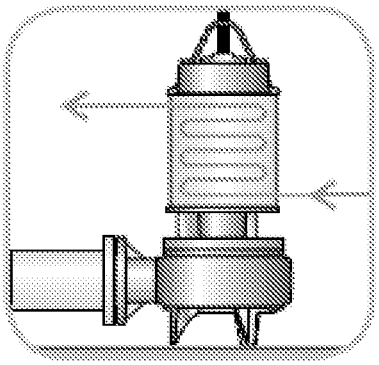
FIG. 2 shows schematic illustrations of a second known cooling system for submersible pumps.
Figure 3:
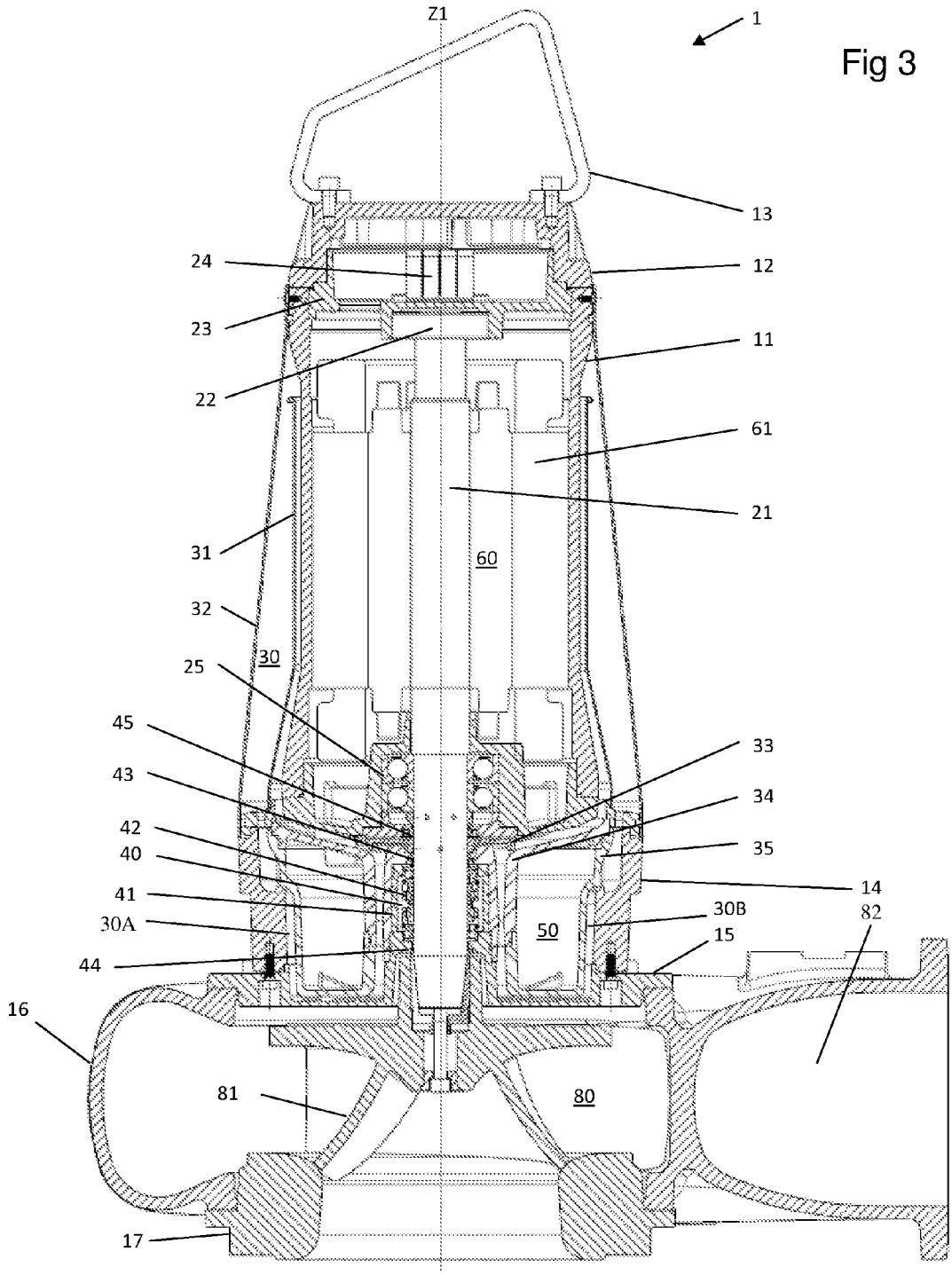
FIG. 3 is a cross-section of a pump in accordance with the present invention.

With reference to FIG. 3, a pump, preferably a submersible pump 1 is shown arranged for emptying drain wells, basements, tanks, or similar.

The pump 1 comprises a motor case 11 having substantially the shape of a hollow cylinder and extending along a first longitudinal axis Z1. At the upper end, the motor case 11 is closed by a motor lid 12. A handle 13 is associated with the motor lid 12 and is arranged for being held by a user in order to raise and/or transport the pump 1. The motor lid 12 also encloses a terminal block 24 for the electrical connection of the motor 61.

The motor case 11 defines an electrical motor chamber 60 extending essentially circumferentially, preferably concentrically around the shaft 21. An electric motor 61 is arranged inside the electrical motor chamber 60. The electric motor 61 comprises a stator and a rotor, and drives a shaft 21. The electrical motor chamber 60 may advantageously be dry or oil filled.

At one end of the drive shaft 21 an impeller 81 is mounted, facing, during the use, a pump flange 17 from where the liquid to be pumped is supplied.

In addition, the pump chamber 80 communicates, by means of a passageway 82, with an outlet duct extending substantially perpendicularly with respect to the first axis Z1 and arranged for conveying outwards the liquid drawn by the pump 1.

The pump further comprises a cooling circuit chamber 30 for being filled with a cooling liquid. A mechanical seal chamber 40 extends essentially circumferentially, preferably concentrically around the shaft 21, with the mechanical seal chamber 40 adapted for being filled preferably with oil.

According to the invention the electrical motor chamber 60, the cooling circuit chamber 30, and the mechanical seal chamber 40 are hermetically sealed from each other.

The cooling circuit chamber 30 extends essentially circumferentially, preferably concentrically around the shaft 21.

At least part of the cooling circuit chamber 30 extends essentially circumferentially, preferably concentrically around the electrical motor chamber 60.

At least part of the cooling circuit chamber 30 extends essentially circumferentially, preferably concentrically around the mechanical seal chamber 40.

The pump further comprises an oil chamber 50 adapted for being filled preferably with oil. The oil chamber 50 extends essentially circumferentially, preferably concentrically around the mechanical seal chamber 40.

The oil chamber 50 extends essentially circumferentially, preferably concentrically around the part of the cooling circuit chamber 30 extending essentially circumferentially, preferably concentrically around the mechanical seal chamber 40.

The oil chamber 50 is in liquid communication with the mechanical seal chamber 40.

Figure 4:
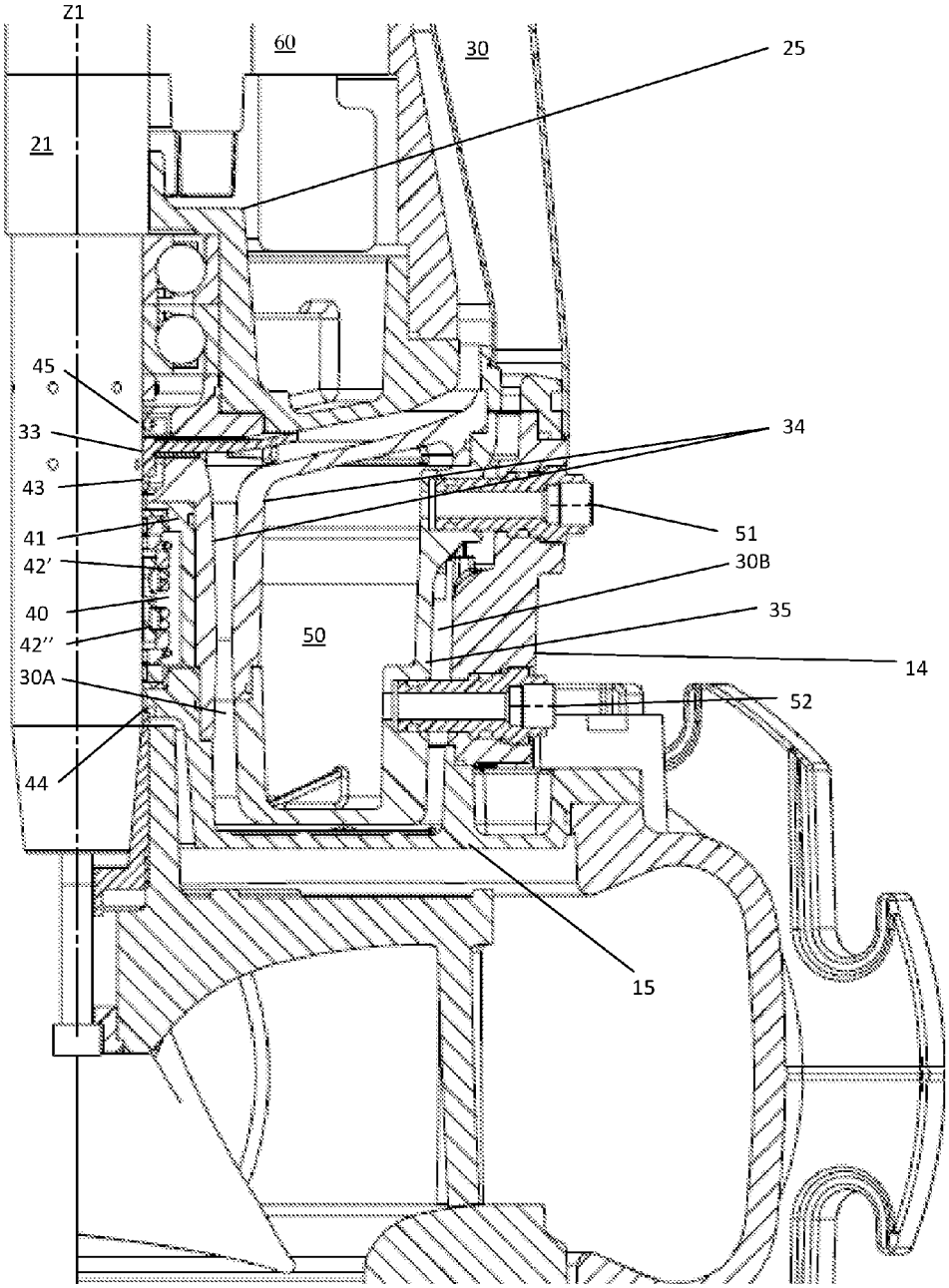
FIG. 4 is a more detailed cross-section of a pump in accordance with a first aspect of the present invention.

Referring now to FIGS. 4 and 5, the pump further comprises a cooling diffuser comprising upper and lower diffuser 34, 35 essentially enclosing the oil chamber 50, wherein the upper cooling diffuser 34 provides at least one essentially radial passageway 39 for the oil to pass between the oil chamber 50 and the mechanical seal chamber 40 and at least one essentially axial passageway 38 for the cooling liquid in the cooling circuit chamber 30, and wherein the at least one radial passageway 39 and the at least one axial passageway 38 are hermetically separated from another.

The total cross section of the axial passageways 38 may advantageously be larger than the total cross section of the radial passageways 39.

It may further be of advantage to provide more than one essentially radial passageway 39 in the upper cooling diffuser 34. Similarly, it may be of advantage to provide more than one essentially axial passageway 38. A currently preferred number of three axial passageways 39 and three radial passageways 38 is shown in FIG. 5*c*.

Figures 5A, 5B, 5C:
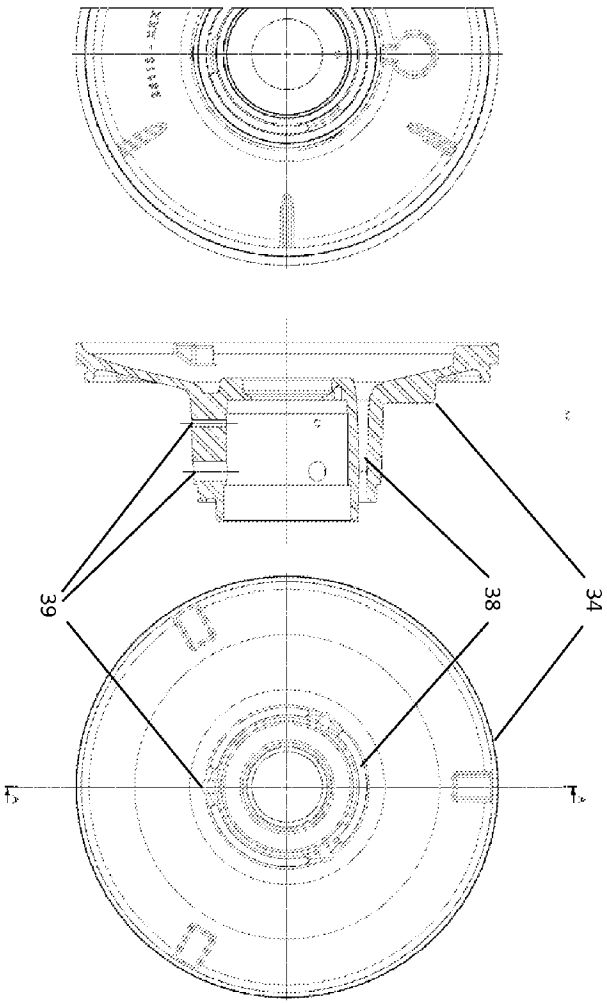
FIGS. 5*a*) to 5*c*) show cross-sections of a cooling diffuser for a pump in accordance with a second aspect of the present invention.

Both the upper and lower diffuser 34, 35 may be provided in a single piece as depicted in FIG. 5*a*)*b*)*c*) without loss of generality. The diffuser may similarly be provided as an assembly of several pieces, which, when installed in the pump, form an upper and lower diffuser essentially enclosing the oil chamber 50, wherein the upper cooling diffuser provides at least one essentially radial passageway for the oil to pass between the oil chamber and the mechanical seal chamber and at least one essentially axial passageway for the cooling liquid in the cooling circuit chamber 30, and wherein the at least one radial passageway and the at least one axial passageway are hermetically separated from another.

The mechanical seal chamber 40 comprises a mechanical seal cartridge 41.

The mechanical seal cartridge 41 may comprise at least one mechanical seal 42. It is preferred to install two mechanical seals 42', 42" as the main pump seals. The mechanical seals may be positioned adjacent to the oil chamber 50 and set in opposition between them. The upper mechanical seal 42' is directed from the top to the bottom of the pump and the lower mechanical seal 42" is directed from the bottom to the top of the pump Advantageously, a leakage detector (not shown in the drawings) may be installed in the mechanical seals chamber 50.

At least one lip or mechanical seal 45 is provided on the shaft 21 for sealing the electrical motor chamber 60 from the cooling circuit chamber 30. The at least one lip seal or mechanical seal 45 is installed to prevent that the cooling liquid can reach the motor chamber during normal pump operation.

At least one upper seal 43 is provided on the shaft 21 for sealing the cooling circuit chamber 30 from the mechanical seal chamber 40, preferably in the form of a V-ring or lip seal. The upper seal 43 is installed in that position just to prevent that, during maintenance of the mechanical seals 42, the liquid of the cooling system could enter the mechanical seals chamber 40. In normal operation the two mechanical seals 42 prevent this, but during maintenance they may be removed.

At least one lower seal 44 is provided on the shaft 21 for sealing the mechanical seal chamber 40 from the pump chamber 80, preferably in the form of a V-ring or lip seal. The lower seal 44 is advantageously installed in contact with the liquid, to prevent any oil leakage and to prevent that any solid part could reach the mechanical seals 42.

FIG. 4 and FIGS. 5*a*) to 5*c*) show cross sections of an upper cooling diffuser 34 for a pump, in particular a submersible pump. The mechanical seal chamber 40 extends essentially circumferentially around the pump shaft 21. The inner part 30A of the cooling circuit chamber 30 extends essentially circumferentially around the mechanical seal chamber 40. The oil chamber 50 extends essentially circumferentially around the inner part 30A of the cooling circuit chamber 30. The outer part 30B of the cooling circuit chamber 30 extends essentially circumferentially around the oil chamber 50. It should be understood throughout what follows that reference numbers 30A and 30B denote two parts or regions of the same chamber 30. With respect to the pump shaft 21, the oil chamber 50 is thus arranged between the inner part 30A and the outer part 30B of the cooling circuit chamber 30. This further means that the mechanical seal chamber 40 and the oil chamber 50 are separated by the inner part 30A of the cooling circuit chamber 30.

The upper cooling diffuser 34 allows the parallel operation of the cooling system and the oil chamber by providing two essentially perpendicular channels. It may be preferred that the cooling diffuser be made up of an upper cooling diffuser 34 and a lower cooling diffuser 35. The upper cooling diffuser 34 provides at least one essentially radial passageway 39 for oil to pass between the oil chamber 50 which extends circumferentially, preferably concentrically at least partially outside the upper cooling diffuser 34 and the mechanical seal chamber 40 which extends essentially circumferentially, preferably concentrically inside the upper cooling diffuser 34. The upper cooling diffuser 34 further comprises at least one essentially axial passageway 38 for a cooling liquid in the cooling circuit chamber 30 which extends essentially axially circumferentially, preferably concentrically with the upper cooling diffuser 34, and wherein the at least one essentially radial passageway 39 and the at least one axial passageway 38 are hermetically separated from another. The total cross section of the at least one essentially axial passageway 38 may be larger than the total cross section of the at least one essentially radial passageway 39.

As shown in FIG. 3, the rotor of the electrical motor 61 runs the internal impeller 33 that moves the cooling liquid in the cooling chamber 30. The cooling liquid is moved to provide an internal flow in the cooling chamber 30, along the internal cooling jacket 31 and the outer surface of the warm motor case 11 to the external cooling jacket 32. Owing to that flow the cooling liquid absorbs the motor heat in order to cool the electric motor 61. Later in the cycle, once it has passed between the external cooling jacket and the internal cooling jacket, it passes through the lower outer part 30B of the cooling chamber 30. The lower outer part 30B of the cooling chamber 30 extend essentially circumferentially around the oil chamber 50. The cooling liquid transfers the heat to the pumped liquid via the lower parts of the pump, such as pump plate 15, and the cooling liquid cools down again, ready to begin another heat transferring cycle. The cooling liquid then passes upwards through the lower inner portion 30A of the cooling chamber 30. The at least one essentially axial passageway 38 also forms part of the lower inner portion 30A of the cooling chamber 30. The lower inner part 30A of the cooling chamber 30 extends essentially circumferentially around the mechanical seals chamber 40, and at the same time, it is circumferentially surrounded by the oil chamber 50.

The liquid cooled by heat surface exchange is pushed up by the internal impeller 33 located above the two mechanical seals 42', 42". This liquid cools down the electric motor 61 and returns down again via the flow channel defined by internal cooling jacket 31 and external cooling jacket 32.

This arrangement is advantageous for the working condition of the mechanical seals because the cooling circuit is fully separated from the mechanical seal chamber. Due to this separation, it is possible to fully fill the mechanical seal chamber 40 with oil so the seal works submerged in oil achieving its best working state.

Two oil caps 51 and 52, in fluid connection with the oil chamber 50 can be used to empty and refill the oil of the oil chamber 50 and mechanical seals chamber 40 without having to interfere with the cooling liquid circuit formed by cooling chamber 30. This operation can be done with the pump in vertical or horizontal position.

The present invention allows both the cooling liquid to flow and the mechanical seal oil to pass between the external side of the pump and the internal seal site, whilst ensuring that they remain hermetically separated.

Preferably, the mechanical seal cartridge 41 may be provided by a special cup, preferably in the shape of a reversed cup, that facilitates the extraction of the mechanical seals 42', 42" during maintenance. Generally the second mechanical seal 42' close to the motor is very hard to extract and with mechanical seal cartridge 41 in the form of a reverse cup this action is simplified.

The present invention allows the pump to obtain the optimal motor temperature, and thus the best efficiency, the best mechanical seal reliability and big improvement of the maintenance of the pump itself.

The present invention focuses on the strong separation of the cooling system from the mechanical seal oil chamber and the preferably dry electrical motor chamber. Of course, the system is fully sealed from the external pumped liquid.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A submersible pump, comprising:

a shaft (21) for driving an impeller (81) in a pump chamber (80), the pump chamber having an inlet and an outlet for a pumped liquid;

an electrical motor chamber (60) extending essentially circumferentially around a motor section of the shaft (21);

a cooling circuit chamber (30) for being filled with a cooling liquid; and a mechanical seal chamber (40) extending essentially circumferentially around a seal section of the shaft (21), with the mechanical seal chamber (40) adapted for being filled with oil, and an oil chamber (50) adapted for being filled with oil, wherein the electrical motor chamber (60), the cooling circuit chamber (30), the mechanical seal chamber (40) and the pump chamber are hermetically sealed from each other, wherein at least part of the cooling circuit chamber (30) extends essentially circumferentially around the electrical motor chamber (60), wherein the oil chamber (50) extends essentially circumferentially around the mechanical seal chamber (40), and wherein the oil chamber (50) extends essentially circumferentially around a part (30A) of the cooling circuit chamber (30) and the cooling circuit extends essentially circumferentially around the mechanical seal chamber (40).

2. The pump in accordance with claim 1, wherein the electrical motor chamber is dry or oil filled.

3. The pump in accordance with claim 1, wherein the cooling circuit chamber (30) extends essentially circumferentially around the shaft (21).

4. The pump in accordance with claim 1, wherein the oil chamber (50) is in liquid communication with the mechanical seal chamber (40).

5. The pump in accordance with claim 4, further comprising a cooling diffuser (34, 35) essentially enclosing the oil chamber (50), wherein at least a part of the cooling diffuser (34) provides at least one essentially radial passageway (39) for the oil to pass between the oil chamber (50) and the mechanical seal chamber (40), and at least one essentially axial passageway (38) for the cooling liquid in the cooling circuit chamber (30), wherein the at least one essentially radial passageway (39) and the at least one essentially axial passageway (38) are hermetically separated from one another.

6. The pump in accordance with claim 5, wherein the total cross section of the at least one essentially axial passageway (38) is larger than the total cross section of the at least one essentially radial passageway (39).

7. The pump in accordance with claim 1, wherein the mechanical seal chamber (40) comprises a mechanical seal cartridge (41) for separating the electrical motor chamber (60) from the pump chamber (80).

8. The pump in accordance with claim 7, wherein the mechanical seal cartridge (41) comprises at least one mechanical seal (42).

9. The pump in accordance with claim 7, wherein the mechanical seal cartridge (41) comprises at least two mechanical seals (42', 42").

10. The pump in accordance with claim 1, wherein the mechanical seal chamber (40) comprises a leak detector.

11. The pump in accordance with claim 1, wherein at least one seal (45) is provided on the seal section of the shaft (21) for sealing the dry electrical motor chamber (60) from the cooling circuit chamber (30).

12. The pump in accordance with claim 11, wherein the at least one seal (45) for sealing the electrical motor chamber (60) from the cooling circuit chamber (30) is selected from a lip seal or mechanical seal.

13. The pump in accordance with claim 1, wherein at least one upper seal (43) is provided on the seal section of the shaft (21) for sealing the cooling circuit chamber (30) from the mechanical seal chamber (40).

14. The pump in accordance with claim 13, wherein the at least one upper seal (43) for sealing the cooling circuit chamber (30) from the mechanical seal chamber (40) is selected from a V-ring or lip seal.

15. The pump in accordance with claim 1, wherein at least one lower seal (44) is provided on the seal section of the shaft (21) for sealing the mechanical seal chamber (40) from the pump chamber (80).

16. The pump in accordance with claim 15, wherein the at least one lower seal (44) for sealing the cooling circuit chamber (30) from the mechanical seal chamber (40) is selected from a V-ring or lip seal.

17. The pump in accordance with claim 1, wherein the cooling liquid comprises glycol.

18. The pump in accordance with claim 16 wherein the cooling liquid further comprises water.

19. The pump in accordance with claim 1, wherein the cooling circuit chamber (30) is in the form of a closed loop for the cooling liquid.

20. The pump in accordance with claim 19, wherein an internal impeller (33) is provided for moving the cooling liquid in the closed-loop cooling circuit chamber (30).

* * * * *

UNITED STATES PATENT AND TRADEMARK OFFICE

CERTIFICATE OF CORRECTION

PATENT NO. : 9,297,386 B2
APPLICATION NO. : 13/822549
DATED : March 29, 2016
INVENTOR(S) : Davide Bottan It is certified that error appears in the above-identified patent and that said Letters Patent is hereby corrected as shown below:

In the claims,

Claim 11, Column 9, Line 5, please delete the word "dry".

Signed and Sealed this
Fifth Day of July, 2016

Michelle K. Lee

Michelle K. Lee
*Director of the United States Patent and Trademark Office*